United States Patent [19]

Neal

[11] 4,045,710

[45] Aug. 30, 1977

[54] DISCHARGE LAMP OPERATING CIRCUIT

[75] Inventor: Wayne R. Neal, Hendersonville, N.C.

[73] Assignee: General Electric Company, New York, N.Y.

[21] Appl. No.: 708,520

[22] Filed: July 26, 1976

[51] Int. Cl.[2] ..... H05B 41/16; H05B 41/36

[52] U.S. Cl. ..... 315/205; 315/171; 315/174; 315/208; 315/240; 315/283; 315/DIG. 7

[58] Field of Search ..... 315/171, 174, 205, 208, 315/209 R, 240, 244, 276, 283, DIG. 7; 321/15, 47; 323/6

[56] References Cited

U.S. PATENT DOCUMENTS

| | | | |
|---|---|---|---|
| 3,143,701 | 8/1964 | Bird | 315/283 X |
| 3,771,014 | 11/1973 | Paget | 315/205 X |
| 3,873,910 | 3/1975 | Willis | 323/6 |

FOREIGN PATENT DOCUMENTS

| | | | |
|---|---|---|---|
| 379,998 | 7/1973 | U.S.S.R. | 315/171 |

*Primary Examiner*—Eugene R. LaRoche
*Attorney, Agent, or Firm*—Sidney Greenberg

[57] ABSTRACT

Color rendition of high pressure sodium vapor discharge lamps is improved by disclosed operating circuit for applying pulsed direct current to the lamp. The circuit includes a direct current ballast circuit having a low ripple factor, a filter capacitor charged by the output of the ballast circuit, and a pulsing circuit comprising a transistor switch which operates to apply DC pulses on the lamp at a predetermined repetition rate and duty cycle to provide desired color properties of the lamp.

7 Claims, 3 Drawing Figures

DISCHARGE LAMP OPERATING CIRCUIT

The present invention relates to discharge lamp operating circuits, and more particularly concerns direct current operating circuits for such lamps.

It is an object of the invention to provide an improved direct current operating circuit for applying direct current pulses on gaseous discharge lamps, especially of high pressure sodium vapor type, to produce improved color properties of the lamp.

Another object of the invention is to provide an operating circuit of the above type which produces a constant supply voltage for operating the lamp.

Still another object of the invention is to provide a lamp operating circuit of the above type which produces pulses of sufficiently high voltage to ensure continuous operation of the lamp.

Other objects and advantages will become apparent from the following description and the appended claims.

With the above objects in view, the present invention relates to a lamp operating circuit comprising, in combination, a source of alternating current, current limiting reactance means comprising a first induction coil connected to the alternating current source, an auxiliary induction coil inductively coupled to the first induction coil, first rectifier means connected to the output of the first induction coil, the first induction coil being connected in series between the current supply source and the first rectifier means, second rectifier means connected to the output of the auxiliary induction coil, and controlled switch, an inductor, and a gaseous discharge lamp connected in series to the output of the first and second rectifier means, control circuit means connected to the controlled switch for turning on the same with a predetermined duty cycle and repetition rate, and diode means connected across the series connected inductor and gaseous discharge lamp.

In a typical embodiment of the invention, the circuit includes a filter capacitor connected across the first and the second rectifier means for increasing the average voltage supplied to the controlled switch. In a preferred embodiment of the invention, the gaseous discharge lamp is constituted by a high pressure sodium vapor discharge lamp, whereby the color of the lamp is improved by application of direct current pulses thereto with the aforementioned predetermined duty cycle and repetition rate.

A related type of circuit employing a particular pulse generating circuit is disclosed in co-pending application Ser. No. 692,078 - Morais, filed June 2, 1976 and assigned to the same assignee as the present invention.

The invention will be better understood from the following description taken in conjunction with the accompanying drawing, in which.

Figure 1:
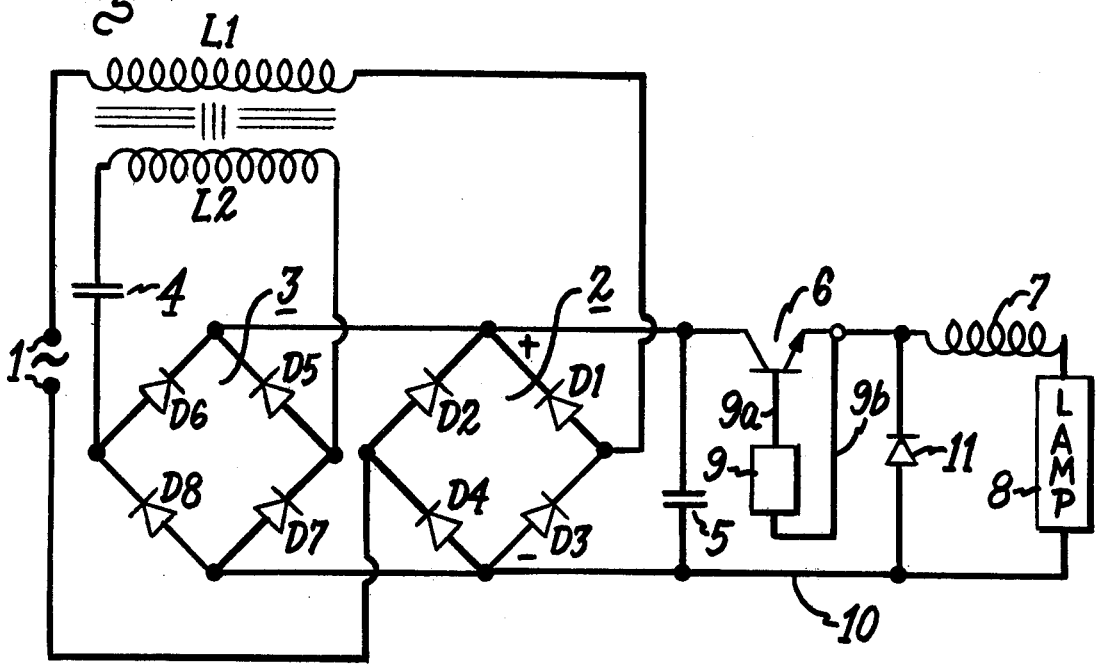
FIG. 1 is a circuit diagram of a direct current supply circuit for pulsed operation of a gaseous discharge lamp in accordance with an embodiment of the invention.

Referring now to the drawings, and particularly to FIG. 1, there is shown a circuit diagram of a typical embodiment of the invention comprising terminals 1 of a source of alternating current, an induction coil L1 connected at one side to one of the source terminals and at the other side to an input terminal of full wave bridge rectifier 2, which comprises diodes D1, D2, D3 and D4 arranged in conventional manner as shown, the other input terminal of bridge rectifier 2 being connected to the other source terminal 1. Auxiliary induction coil L2 is inductively coupled to main induction coil L1, such as by arrangement of the two coils on a common magnetic coil on opposite sides of a magnetic shunt. Such an arrangement of inductively coupled coils is shown, for example, in the patent to Willis U.S. Pat No. 3,873,910, assigned to the same assignee as the present invention, and the disclosure thereof is accordingly incorporated herein by reference. Auxiliary induction coil L2 is connected at opposite sides respectively to the input terminals of another full wave bridge rectifier 3 similar to bridge rectifier 2 and comprising diodes D5, D6, D7 and D8. The output terminals of bridge rectifier 3 are connected to the output terminals of bridge rectifier 2 which in turn are connected across filter capacitor 5 and the associated pulsing circuit for operating lamp 8. The latter is typically a high intensity gaseous discharge lamp, particularly a high pressure sodium vapor lamp, such as more fully described below. Due to this arrangement, the direct current supplied to filter capacitor 5 by main induction L1 via bridge rectifier 2 is substantially out of phase with the direct current supplied to the filter capacitor by auxiliary coil L2 via bridge rectifier 3. As a result, the average current through the capacitor and the voltage across the same is substantially increased over the average magnitude of current and voltage which would be applied in the absences of auxiliary coil L2 and its associated rectifier circuit.

Figure 2:
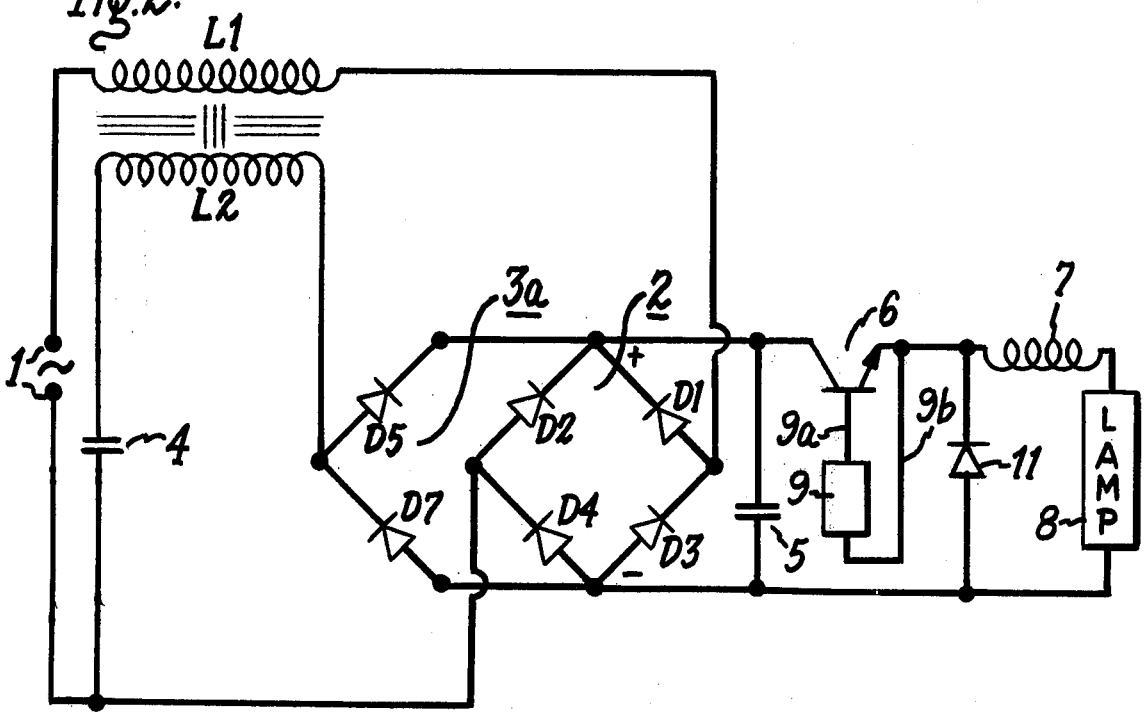
FIG. 2 is a circuit diagram showing a modification of the FIG. 1 circuit.

In the modification shown in FIG. 2, rectifier 3*a* is constituted by diodes D5 and D7 co-acting with diodes D2 and D4 to provide full wave rectification of the current from auxiliary coil L2.

Capacitor 4 connected between auxiliary coil L2 and an input terminal bridge rectifier 3 (or 3*a*) is selected such that in conjunction with the leakage reactance existing between induction coil L1 and L2, it serves to provide the desired phase shift and power factor. If induction coil L2 and capacitor 4 are selected so that the portion of the magnetic core associated with coil L2 is saturated, a higher degree of lamp wattage regulation is achieved for a wide range of input voltage.

A DC supply circuit of the above described type is disclosed in co-pending application Ser. No. 608,531 - Neal, filed Aug. 28, 1975 and assigned to the same assignee as the present invention, and the disclosure of the application is accordingly incorporated herein by reference.

In the embodiment of the present invention illustrated in FIG. 1, filter capacitor 5 connected across the DC supply circuit provides a filtered DC voltage supply for the pulse generating circuit described hereinafter and increases the average voltage supplied thereto.

In accordance with the present invention, the described direct current supply circuit is used in combination with a controlled pulse generating circuit for applying DC pulses of predetermined duty cycle and repetition rate on lamp 8 for improving the color and other properties of the lamp. A method and apparatus for pulsed operation of high pressure sodium vapor lamps for improving the color rendition of the lamps are disclosed in co-pending application Ser. No. 649,900 - Osteen, filed Jan. 16, 1976 and assigned to the same assignee as the present invention.

As disclosed in the Osteen application, the high pressure sodium vapor lamp typically has an elongated arc tube containing a filling of xenon at a pressure of about 30 torr as a starting gas and a charge of 25 milligrams of amalgam of 25 weight percent sodium and 75 weight percent mercury.

The present invention provides an improved circuit for DC pulse operation of such lamps in accordance with the method and principles disclosed in the copending Osteen application, and the disclosure thereof in that application is accordingly incorporated herein by reference. As there disclosed, pulses may be applied to the lamp having repetition rates above 500 to about 2000 Hertz and duty cycles from 10% to 30%. By such operation, the color temperature of the lamp is readily increased and substantial improvement in color rendition is achieved without significant loss is efficacy or reduction in lamp life.

Figure 3:
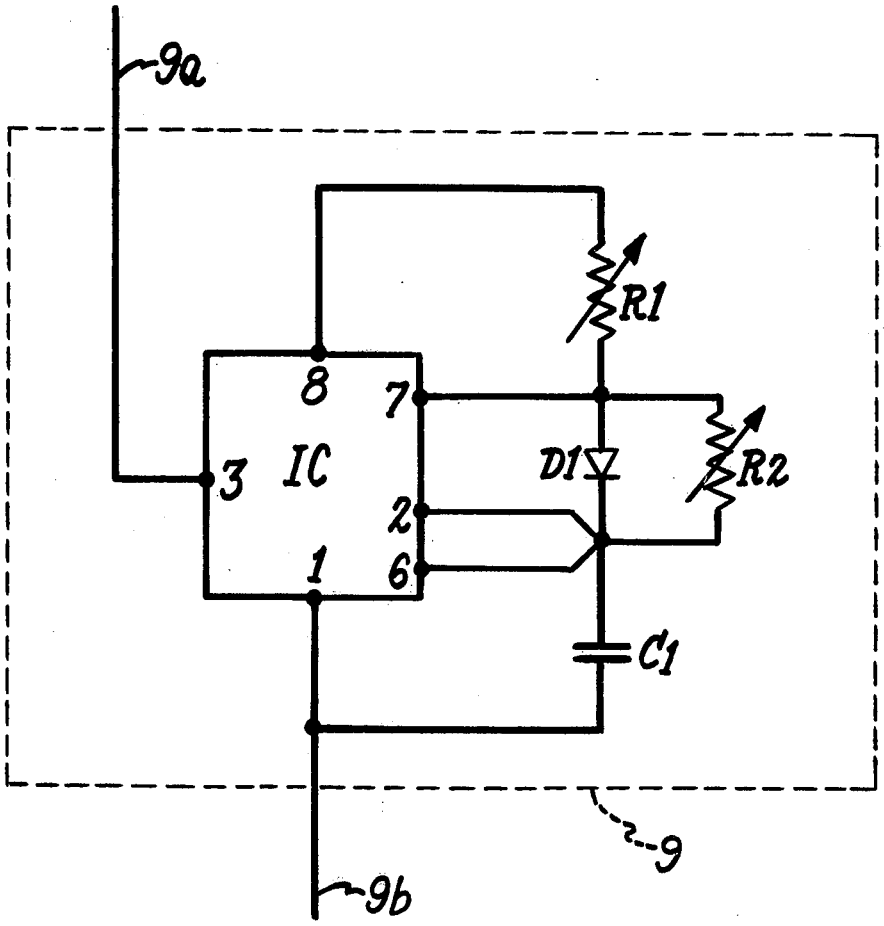
FIG. 3 is a circuit diagram of the switch control circuit shown in FIGS. 1 and 2.

In the embodiment illustrated in FIG. 1, the pulsing circuit including gaseous discharge lamp 8 is connected across the above-described DC supply circuit to the common output terminals of bridge rectifiers 2 and 3. The circuit comprises filter capacitor 5 connected across the first and second rectifier means, transistor switch 6 and current limiting induction coil 7 connected in series between one terminal of the DC supply circuit and lamp 8, the other side of the lamp being connected by conductor 10 to the other terminal of the rectifier circuit. Switch control circuit 9, which functions as a pulse generator and may have the structure shown in FIG. 3, is connected to the DC supply circuit with lead 9*a* connected to the base of transistor 6 and lead 9*b* connected to the emitter of transistor 6 as shown. Diode 11 connected across series connected inductor 7 and a lamp 8 serves as a coating diode to protect transistor switch 6 after turn-off from excessive voltage due to collapse of the magnetic field of inductor 7.

In the operation of the described circuit, the current output from the DC supply circuit charges filter capacitor 5 up to peak line voltage, e.g., 400 volts, this voltage serving as the electrical supply for transistor switch 6 and associated circuit. Capacitor 5 serves to provide constant supply voltage to the switch circuit, and also provides high peak current at low duty cycle for improved color of the high pressure sodium vapor lamp. Control circuit 9 actuates transistor switch 6 at the desired repetition rate and duty cycle, so that when thus turned on, switch 6 supplies direct current pulses to lamp 8 for operating the latter.

Switch 6 is depicted as a simple transistor having its emitter-collector path connected in series with lamp 8 and its base-emitter supplied with control signals. However, any suitable electronic equipment capable of turning on and shutting off current flow from the DC supply circuit in a controlled manner may be used. Pulse generator 9, which may be of any suitable known type such as shown in detail in FIG. 3, is connected to transistor 6 to supply pulses thereto for turning the switch on. During the time interval while transistor 6 is on, the voltage of the DC supply circuit is applied across the combination of lamp 8 and ballast 7. The equipment permits the pulse frequency or pulse repetition rate, the pulse duration and the pulse amplitude to be controlled at will.

As seen in FIG. 3, the pulse generator comprises an integrated circuit IC such as a type NE555 available from Signetics Corporation. The integrated circuit consists of a bistable circuit whose output is either high (near positive IC power supply voltage) or low (near common or negative IC power supply voltage). The circuit is triggered into the high state when the voltage at the "trigger" (pin 2) goes below one third V where V is the IC supply voltage. The circuit is triggered into the low state when the voltage is the "threshold" (pin 6) goes above two third V. The "discharge" (pin 7) exhibits a short circuit to the IC common when the circuit is in the low state. Pin 8 is the positive power supply input, pin 1 is the power supply common (negative) voltage, and pin 3 is the output voltage. It will be understood that an independent power supply (not shown) would be connected to pin 8 and pin 1.

Variable resistor R1 is adjustable to obtain the desired pulse "on" time, with a higher resistance being used for producing a wider pulse, and a lower resistance for a narrower pulse. Variable resistor R2 is adjustable to obtain the desired pulse "off" time, with a high resistance being used for producing a greater "time" time. It will be evident that control of pulse repetition rate and pulse duty cycle may be obtained by suitable adjustment of either resistor R1 or resistor R2, or both, as appropriate.

In the operation of the FIG. 3 circuit, in which pins 2 and 6 are both connected to timing capacitor C1, when the voltage on timing capacitor C1 goes higher than two third V, the "threshold" input (pin 6) will cause the output (pin 3) to go low and the "discharge" output (pin 7) to go low. When the voltage on the timing capacitor goes below one third V, the "trigger" input (pin 2) will cause the output to go high, and the discharge output to turn off. The operation, then, is as follows. Assume that the voltage on C1 has dropped to one third V. The output is then high, and the discharge output (pin 7) is turned off. The C1 will charge through resistor R1 and diode D1 with a time constant R1C1. When the voltage on C1 reaches two third V, the output will go low and the pin 7 will go low. This will discharge C1 with a time constant R2C1. When the voltage C1 reaches one third V, the cycle begins again.

By virtue of the particular DC supply circuit described, the average current from the output of rectifiers 2 and 3 which charges filter capacitor 5 is increased, thereby providing a more constant voltage across the capacitor. The DC suppply circuit thus makes possible the use of a smaller and less expensive filter capacitor than would otherwise be necessary in order to produce a low ripple voltage source for the transistor switch pulse generating circuit. Such a property is desirable in order to provide the desired improvement in the color of the lamp illumination. Also, in the absence of the described DC supply circuit, the rapid rising, high current pulses which would then be required to charge the filter capacitor would be likely to cause the undesirable radio frequency interference in nearby electrical equipment, and such interference is largely avoided by the described circuit.

In the described circuit, inductor L1 serves as a current limiting and buffer means between the AC and DC power supplies, so as to avoid the aforementioned radio frequency interference and to protect the circuit against line surges. Inductor 7 in series with lamp 8 serves as a ballast means for limiting the current through the lamp during its operation. The inductance of inductor 7 should be small enough so that the LR time constant, where L is represented by inductor 7 and R by the equivalent resistance of the lamp, is short enough for the lamp current to rise to its peak value and then drop to zero during a duty cycle of 10% to 30%.

In a typical circuit which provided satisfactory results in accordance with the invention, capacitor 5 had a value of 100 microfarads, inductor 7 was 150 microhenries, L1 was 120 millihenries, the leakage reactance between L1 and L2 was 81 millihenries, and the turns ratio of L1 to L2 was 1.5 to 1.

In general, with a pulse duty cycle between 10% and 30%, capacitor 5 should be in the range of about 50 to 150 microfarads, and inductor 7 in the range of about 100 to 400 microhenries.

While best results are obtained with the use of a filter capacitor 5 as described above, this capacitor may be omitted under appropriate conditions.

While the present invention has been described with reference to particular embodiments thereof, it will be understood that numerous modifications may be made by those skilled in the art without actually departing from the scope of the invention. Therefore, the appended claims are intended to cover all such equivalent variations as come within the true spirit and scope of the invention.

What I claim as new and desire to secure by Letters Patent of the United States is:

1. A lamp operating circuit comprising, in combination, a source of alternating current, current limiting reactance means comprising a first induction coil connected to said alternating current source, and auxiliary induction coil inductively coupled to said first induction coil, first rectifier means connected to the output of said first induction coil, said first induction coil being connected in series between said alternating current source and said first rectifier means, second rectifier means connected to the output of said auxiliary induction coil, and a DC pulsing circuit connected to said first and second rectifier means and comprising unidirectional controlled switch means and an inductor connected in series to said first and second rectifier means, means for serially connecting a gaseous discharge lamp in said DC pulsing circuit, diode means connected across the series connected inductor and lamp connecting means, and control means connected to said unidirectional controlled switch means for intermittently operating the same at predetermined intervals, whereby DC pulses are applied to the gaseous discharge lamp for operation thereof.

2. A circuit as defined in claim 1, wherein a filter capacitor is connected across said first and second rectifier means at the output thereof.

3. A circuit as defined in claim 2, said unidirectional controlled switch means comprising a transistor switch.

4. A circuit as defined in claim 2, and a high pressure sodium vapor lamp serially connected in said DC pulsing circuit.

5. A circuit as defined in claim 2, and capacitance means connected in series between said auxiliary induction coil and said second rectifier means.

6. A circuit as defined in claim 4, said control means including means for intermittently operating said switch means to provide unidirectional pulses at a repetition rate of about 500 to 2000 Hertz and a duty cycle of about 10 to 30%, for increasing the color temperature of said high pressure sodium vapor lamp.

7. A circuit as defined in claim 6, said filter capacitor having a capacitance of about 50 to 150 microfarads, and said inductor having an inductance of about 100 to 400 microhenries.

* * * * *